US012419483B2

(12) United States Patent
Steele

(10) Patent No.: US 12,419,483 B2
(45) Date of Patent: Sep. 23, 2025

(54) APPLIANCE AND METHOD FOR OPERATION USING FLUID LEVEL DETECTION BY PATTERN RECOGNITION OF MOTOR CURRENT

(71) Applicant: Haier US Appliance Solutions, Inc., Wilmington, DE (US)

(72) Inventor: Victoria Steele, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 399 days.

(21) Appl. No.: 17/743,816

(22) Filed: May 13, 2022

(65) Prior Publication Data

US 2023/0363615 A1 Nov. 16, 2023

(51) Int. Cl.
*A47L 15/00* (2006.01)
*A47L 15/42* (2006.01)

(52) U.S. Cl.
CPC ..... *A47L 15/0023* (2013.01); *A47L 15/0049* (2013.01); *A47L 15/4225* (2013.01); *A47L 2401/08* (2013.01); *A47L 2401/09* (2013.01); *A47L 2501/05* (2013.01)

(58) Field of Classification Search
CPC ..... A47L 15/0023; A47L 15/0049; A47L 15/4225; A47L 2401/08; A47L 2401/09; A47L 2501/05; D06F 2103/18; D06F 2103/42; D06F 2103/48
USPC ..... 702/179
See application file for complete search history.

(56) References Cited

U.S. PATENT DOCUMENTS

| | | | | |
|---|---|---|---|---|
| 8,277,571 | B2 | 10/2012 | Didat | |
| 8,282,361 | B2 | 10/2012 | Mehlhorn et al. | |
| 9,609,997 | B2 | 4/2017 | Fryman et al. | |
| 9,844,801 | B2 | 12/2017 | Kim et al. | |
| 2015/0265128 | A1* | 9/2015 | Pers | A47L 15/0049 134/18 |
| 2018/0275199 | A1* | 9/2018 | Parkin | G01R 19/2513 |
| 2019/0174989 | A1* | 6/2019 | Persson | D06F 33/36 |
| 2021/0054846 | A1 | 2/2021 | Stiles, Jr. et al. | |
| 2021/0164143 | A1* | 6/2021 | Kang | D06F 33/42 |
| 2023/0266391 | A1* | 8/2023 | Tateishi | H02P 29/024 324/500 |

FOREIGN PATENT DOCUMENTS

| | | | |
|---|---|---|---|
| CH | 694495 | A5 | 2/2005 |
| CN | 108697297 | B | 9/2021 |
| DE | 102008029910 | B4 | 1/2014 |
| JP | 2018168772 | A | 11/2018 |

* cited by examiner

*Primary Examiner* — Catherine T. Rastovski
(74) *Attorney, Agent, or Firm* — Dority & Manning, P.A.

(57) ABSTRACT

An appliance and method for operating an appliance is provided. The appliance includes a pump configured to flow a volume of fluid, a flow nozzle configured to eject the fluid provided from the pump, and a motor configured to selectively operate the pump to flow the fluid through the flow nozzle. The method includes acquiring a dataset including a function of current magnitude and time corresponding to operation of a pump to flow a volume of fluid; determining an average current magnitude based at least on the dataset; determining a standard deviation based at least on the average current magnitude; comparing the standard deviation to a threshold to determine whether to transmit a control command based.

17 Claims, 6 Drawing Sheets

APPLIANCE AND METHOD FOR OPERATION USING FLUID LEVEL DETECTION BY PATTERN RECOGNITION OF MOTOR CURRENT

FIELD OF THE INVENTION

The present subject matter relates generally to appliances having one or more pumps for circulating or draining a fluid, and more particularly to dishwashing appliances or laundry washing appliances having a pump.

BACKGROUND OF THE INVENTION

Appliances, such as dishwashing appliances or laundry washing appliances, generally include a cabinet that defines a wash chamber for receipt of articles for washing. Spray assemblies within the wash chamber can apply or direct wash fluid towards articles disposed within the wash chamber in order to clean such articles. Such appliances generally include pumps that flow the wash fluid into the wash chamber and remove the wash fluid from the wash chamber. Such pumps may include circulation pumps or drain pumps configured to provide and remove wash fluid at a wash chamber at a dishwashing appliance or laundry washing appliance.

Methods for operating such pumps may generally require discrete signals or thresholds that may be particular to the appliance or appliance configuration. However, such signals or thresholds may be insufficient for accurate or precise operation of the appliance over time, or based on changing operating conditions. For instance, discrete periods of time of operation of the pump may be insufficient for draining the wash fluid, or may over-fill the wash chamber, or may insufficiently fill the wash chamber. In other instances, operating a pump under low fluid conditions may cause undesired noise and damage to the pump.

As such, there is a need for systems and methods for operating such appliances. In particular, it would be advantageous to provide an appliance configured to efficiently operate the pump to provide or drain fluid from the wash chamber.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for operating an appliance is provided. The appliance includes a pump configured to flow a volume of fluid, a flow nozzle configured to eject the fluid provided from the pump, and a motor configured to selectively operate the pump to flow the fluid through the flow nozzle. The method includes acquiring a dataset including a function of current magnitude and time corresponding to operation of a pump to flow a volume of fluid; determining an average current magnitude based at least on the dataset; determining a standard deviation based at least on the average current magnitude; comparing the standard deviation to a threshold to determine whether to transmit a control command based.

Another aspect of the present disclosure is directed to an appliance. The appliance includes a cabinet forming a wash chamber, a pump, a flow nozzle, a motor, and a controller. The wash chamber is configured to contain a volume of fluid. The pump is configured to flow the fluid to or from the wash chamber. The flow nozzle is configured to eject the fluid into the wash chamber, the flow nozzle in fluid communication with the pump to receive the fluid therefrom. The motor is operably coupled to the pump and is configured to energize the pump to selectively flow the fluid through the flow nozzle. The controller is operably coupled to the motor and is configured to perform operations. The operations include acquiring a dataset comprising a function of current magnitude and time corresponding to operation of the pump to flow the volume of fluid; determining an average current magnitude based at least on the dataset; determining a standard deviation based at least on the average current magnitude; and comparing the standard deviation to a threshold to determine whether to transmit a control command to the motor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
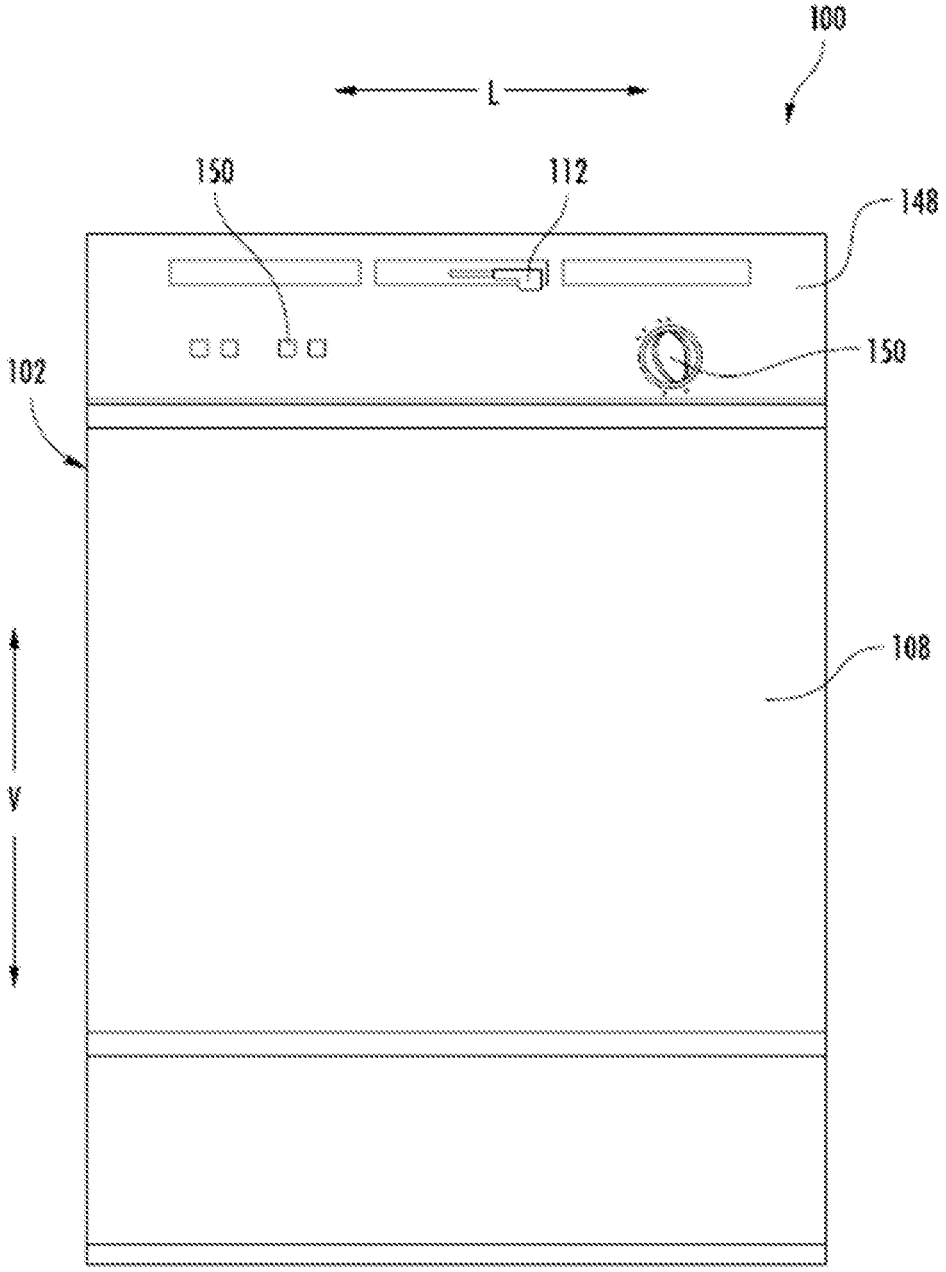
FIG. 1 provides a front elevation view of a dishwashing appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
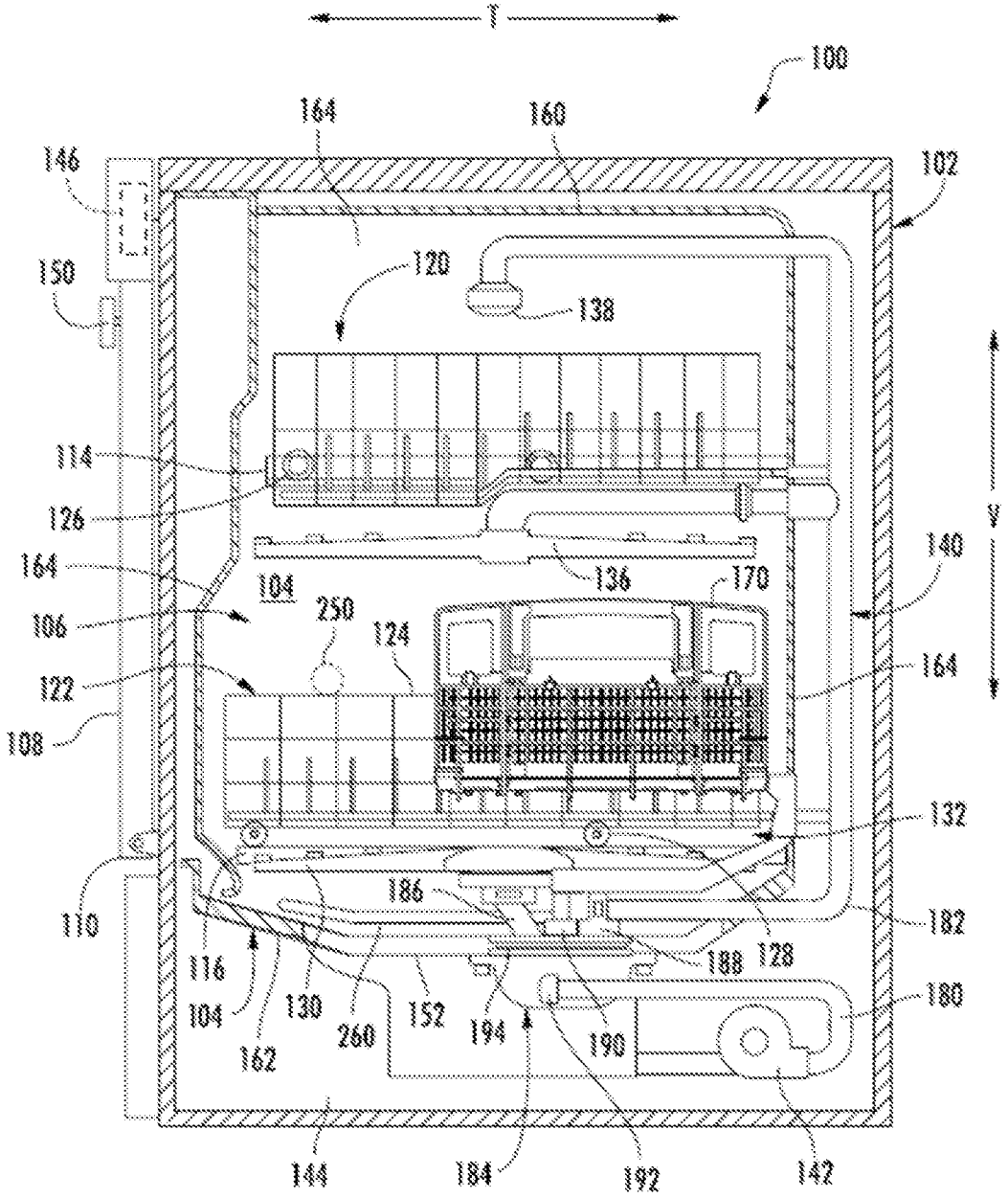
FIG. 2 provides a side, sectional view of the exemplary dishwashing appliance of FIG. 1.

Turning now to the figures, FIGS. 1 and 2 illustrate a domestic dishwashing appliance 100 according to exemplary embodiments of the present disclosure. As shown in FIGS. 1 and 2, the dishwashing appliance 100 may include a cabinet 102 having a tub 104 therein defining a wash chamber 106. The tub 104 may generally include a front opening and a door 108 hinged at its bottom 110 for rotatable movement between a closed or vertical position (shown in FIGS. 1 and 2), wherein wash chamber 106 is sealed shut for washing operation and access to wash chamber 106 is restricted, and a horizontal open position for loading and unloading of articles from the dishwashing appliance 100. As shown in FIG. 1, a latch 112 may be used to lock and unlock the door 108 for access to the chamber 106.

Generally, cabinet 102 may define a discrete vertical direction V, lateral direction L, and transverse direction T. Vertical direction V, lateral direction L, and transverse direction T are mutually perpendicular such that vertical direction V, lateral direction L, and transverse direction T form an orthogonal directional system. Cabinet 102 is generally configured for containing or supporting various components of appliance 100 and which may also define one or more internal chambers or compartments of appliance 100. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof) It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. However, in optional embodiments, the tub 104 may be formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside wash chamber 106, and a retracted position (shown in FIGS. 1 and 2) in which the rack 120, 122 is located inside wash chamber 106. This may be facilitated by rollers 126 and 128, for example, mounted onto racks 120 and 122, respectively.

In some embodiments, a silverware basket 170 is removably mounted to lower rack assembly 122. However, in alternative exemplary embodiments, the silverware basket 170 may also be selectively attached to other portions of dishwashing appliance 100 (e.g., door 108) or absent therefrom. The silverware basket 170 defines one or more storage chambers and is generally configured to receive of silverware, flatware, utensils, and the like, that are too small to be accommodated by the upper and lower rack assemblies 120, 122. The silverware basket 170 may be constructed of any suitable material (e.g., metal or plastic) and define a plurality of fluid slots for permitting wash fluid therethrough.

The dishwashing appliance 100 includes one or more spray assemblies housed within wash chamber 106. For instance, the dishwashing appliance 100 may include a lower spray-arm assembly 130 that is rotatably mounted within a lower region 132 of wash chamber 106 directly above the bottom wall 162 of the tub 104 so as to rotate in relatively close proximity to the rack assembly 122. As shown in FIG. 2, a mid-level spray-arm assembly 136 may be located in an upper region of wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a spray (e.g., a spray of washing fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within wash chamber 106.

The dishwashing appliance 100 may be further equipped with a controller 146 configured to regulate operation of the dishwasher 100. The controller 146 may be positioned in a variety of locations throughout dishwashing appliance 100. In the illustrated embodiment, the controller 146 is located within a control panel area 148 of the door 108, as shown in FIG. 1. In some such embodiments, input/output ("I/O") signals are routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 146 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 146 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 146 may be operable to execute programming instructions or micro-control code associated with an operating cycle of an appliance. In this regard, the instructions may be software or any set of instructions that when executed by the processing device, cause the processing device to perform operations, such as running one or more software applications, displaying a user interface, receiving user input, processing user input, adjusting a pump speed or pressure, adjusting a fluid fill level (e.g., adding fluid or draining fluid), etc. Moreover, it should be noted that controller 146 as disclosed herein is additionally, or alternatively, configured to store, execute, or otherwise operate or perform any one or more methods, method steps, or portions of methods as disclosed herein. For example, in some embodiments, methods disclosed herein may be embodied in programming instructions stored in the memory and executed by controller 146. The memory devices may also store data that can be retrieved, manipulated, created, or stored by the one or more processors or portions of controller 146. One or more database(s) can be connected to controller 146 through any suitable communication module, communication lines, or network(s).

In some embodiments, an air sensor 250 is mounted within wash chamber 106 (e.g., to tub 104) in communication (e.g., electric or wireless communication) with controller 146 to transmit one or more signals thereto. In particular, air sensor 250 may be configured detect a condition of the air or environment within wash chamber 106 and transmit one or more signals corresponding to the controller 146 based on or corresponding to the detected condition. Such conditions may include temperature or humidity within the wash chamber 106 (e.g., during a washing operation or dry cycle in which a heater, such as heater 260 or 261 is active to heat air and articles within wash chamber 106). In some embodiments, the air sensor 250 includes or is provided as a temperature sensor (e.g., thermistor, thermocouple, etc.) configured to detect air temperature (e.g., as an air temperature value), which may in turn be transmitted to the controller 146. In additional or alternative embodiments, the air sensor 250 includes or is provided as a humidity sensor (e.g., capacitive hygrometer, resistive hygrometer, thermal hygrometer, optical hygrometer, etc.) configured to detect water vapor or air humidity (e.g., as an air humidity value), which may in turn be transmitted to the controller 146.

Generally, air sensor 250 may be disposed at any suitable location within wash chamber 106. In some embodiments, air sensor 250 is located below one or more spray assemblies 130, 136, 138. In additional or alternative embodiments, air sensor 250 is located below one or both of rack assemblies 120, 122 (e.g., upper rack 120). Moreover, as shown, air sensor 250 may be mounted at the bottom half or third of top. In other words, air sensor 250 may be provided at a height below a halfway or two-thirds point of a total height of wash chamber 106 (e.g., from bottom wall 162 to top wall 160) along the vertical direction V.

In additional or alternative embodiments, a water sensor 252 is mounted within cabinet (e.g., within or along a water path 212 of a cold water loop 230) in communication (e.g., electric or wireless communication) with controller 146 to transmit one or more signals thereto. In particular, water sensor 252 may be configured detect a condition of the water path 212 and transmit one or more signals corresponding to the controller 146 based on or corresponding to the detected condition. Such conditions may include water temperature (e.g., during a washing operation or dry cycle in which a heater, such as heater 260 or 261 is active to heat air and articles within wash chamber 106). In some embodiments, the water sensor 252 includes or is provided as a temperature sensor (e.g., thermistor, thermocouple, etc.) configured to detect water temperature (e.g., as a water temperature value), which may in turn be transmitted to the controller 146.

Additionally or alternatively, as shown in FIG. 2, a portion of the bottom wall 162 of the tub 104 may be configured as a tub 104 sump portion 152 that is configured to accommodate one or more components of the fluid recirculation assembly 140 (e.g., a filter assembly or other components). It should be appreciated that, in several embodiments, the bottom wall 162 of the tub 104 may be formed as a single, unitary component such that the tub 104 sump portion 152 as well as the surrounding portions of the bottom wall 162 are formed integrally with one another. Alternatively, the tub 104 sump portion 152 may be configured as a separate component configured to be attached to the remaining portion(s) of the bottom wall 162.

Optionally, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Additionally, the diverter assembly 184 may also include a diverter valve 194 to selectively divert the flow of fluid through the assembly 184 to the first outlet 186, the second outlet 188, or the third outlet 190.

In additional or alternative embodiments, a heater 260 (e.g., electric heating element) is mounted within wash chamber 106. Generally, heater 260 may include or be provided as any suitable air heating element, such as a resistive heat element, radiant heat element, etc. When assembled, heater 260 may be positioned on or above a bottom wall of tub 104. Moreover, heater 260 may be in operative (e.g., electrical or wireless) communication with controller 146. Controller 146 may thus selectively activate heater 260 to operate or otherwise generate heat within wash chamber 106.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Figure 3:
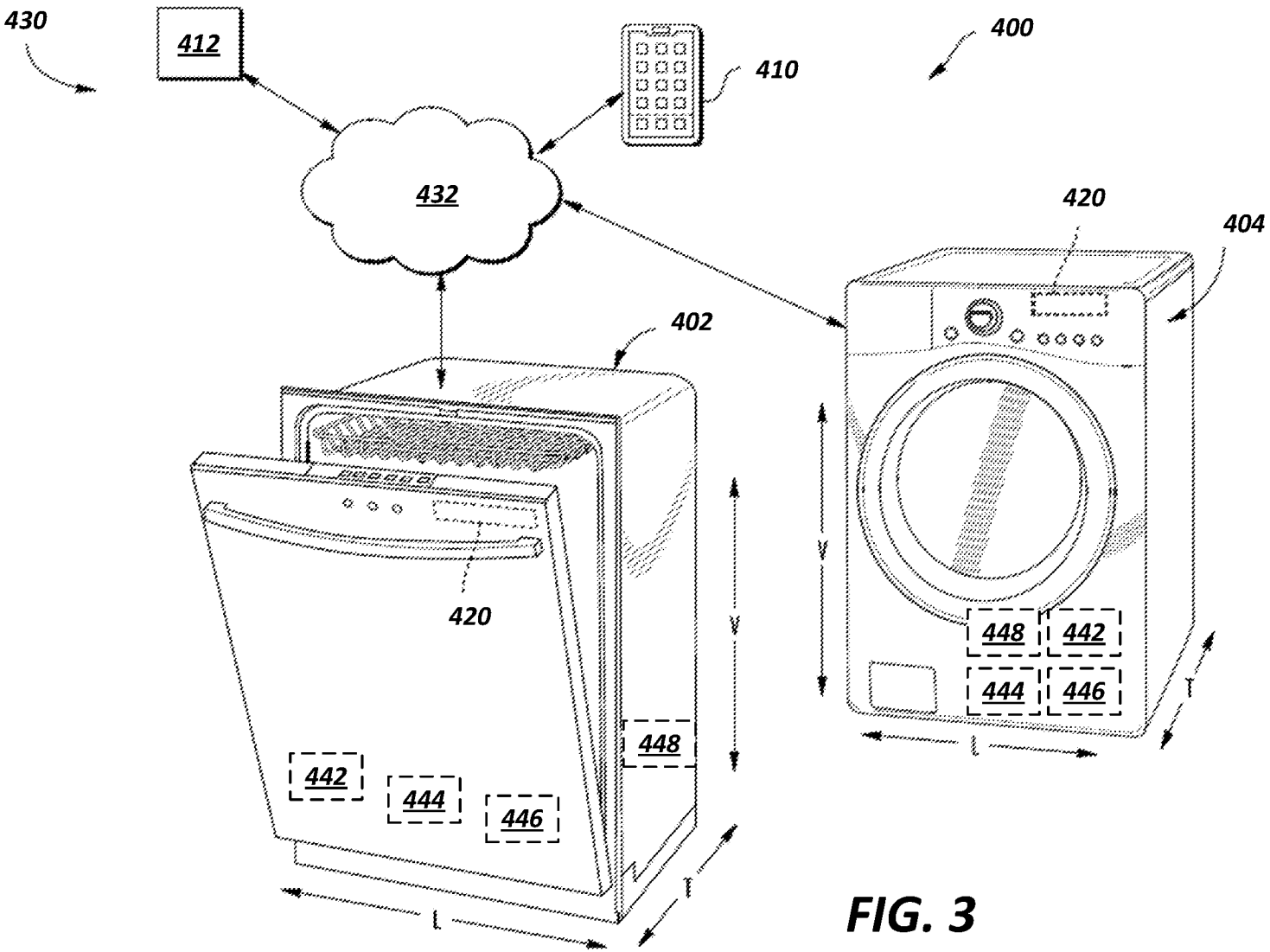
FIG. 3 provides a schematic view of an appliance control system according to exemplary embodiments of the present disclosure.

Referring now to FIG. 3, a computing network 400 including one or more appliances 402 will be described according to exemplary embodiments of the present subject matter. In general, the network 400 may include any suitable number, type, and configuration of appliances such as described herein, remote servers, network devices, and/or other external devices. Some of these appliances 402 may be able to communicate with each other or are otherwise interconnected. This interconnection, interlinking, and interoperability of multiple appliances and/or devices may commonly be referred to as "smart home" or "connected home" appliance interconnectivity.

FIG. 3 illustrates the computing network 400 according to exemplary embodiments of the present subject matter. As shown, the computing network 400 generally includes one or more appliances 402, 404 having a pump configured to circulate, re-circulate, drain or otherwise move fluid (e.g., wash fluid) into, through, and out of a wash chamber. Appliance 402, 404 may further include a flow nozzle configured to eject, spray, or otherwise distribute fluid into the wash chamber. As depicted in FIG. 3, appliance 402 may form a dishwashing appliance, such as depicted and described in regard to dishwashing appliance 100 in FIGS. 1-2. Appliance 404 may form a laundry washing appliance including a pump and flow device. Details regarding the operation of appliances 402, 404 may be understood by one having ordinary skill in the art and further detailed discussion is omitted herein for brevity. However, it should be appreciated that the specific appliance types and configurations are only exemplary and are provided to facilitate discussion regarding the use and operation of an exemplary computing network 400 for one or more appliances such as described herein. The scope of the present subject matter is not limited to the specific number, type, and configurations of appliances set forth herein.

In addition, it should be appreciated that the computing network 400 may include one or more external devices, e.g., devices that are separate from or external to the one or more appliances, and which may be configured for facilitating communications with various appliances or other devices. For example, the computing network 400 may include or be communicatively coupled with a remote user interface device 410 that may be configured to allow user interaction with some or all appliances or other devices in the computing network 400.

In general, remote user interface device 410 may be any suitable device separate and apart from appliances (e.g., such as appliances 402, 404) that is configured to provide and/or receive communications, information, data, or commands from a user. In this regard, remote user interface device 410 may be an additional user interface to the user interface panels of the various appliances within the computing network 400. In this regard, for example, the user interface device 410 may be a personal phone, a smartphone, a tablet, a laptop or personal computer, a wearable device, a smart home system, or another mobile or remote device. For example, the separate device may be a smartphone operable to store and run applications, also known as "apps," and the remote user interface device 410 be provided as a smartphone app.

As will be described in more detail below, some or all of the computing network 400 may include or be communicatively coupled with a remote server 412 that may be in operative communication with some or all appliances within computing network 400. Thus, user interface device 410 and/or remote server 412 may refer to one or more devices that are not considered household appliances as used herein. In addition, devices such as a personal computer, router, network devices, and other similar devices whose primary functions are network communication and/or data processing are not considered household appliances as used herein.

As illustrated, each of appliance 402, 404, remote user interface device 410, or any other devices or appliances in computing network 400 may include or be operably coupled to a controller, identified herein generally by reference numeral 420. Controller 420, remote server 412, and user interface device 410 may be configured as processors or computing devices such as described in regard to controller 146.

Referring still to FIG. 3, a schematic diagram of an external communication system 430 will be described according to an exemplary embodiment of the present subject matter. In general, external communication system 430 is configured for permitting interaction, data transfer, and other communications between and among one or more of the appliances 402, 404 remote user interface device 410, and the remote server 412. For example, this communication may be used to transmit packets of data or datasets through a network 432 and to the remote server 412 and to receive at one or more appliances a fluid parameter adjustment corresponding to one or more of operating parameters, cycle settings, user instructions or notifications, performance characteristics, user preferences, or any other suitable information for improved performance of one or more appliances within system of appliances 100.

In addition, remote server 412 may be in communication with the appliance 402, 404 and/or remote user interface device 410 through the network 432. In this regard, for example, remote server 412 may be a cloud-based server 412, and is thus located at a distant location, such as in a separate state, country, etc. According to an exemplary embodiment, remote user interface device 410 may communicate with a remote server 412 over network 432, such as the Internet, to transmit/receive data packets or information, datasets, provide user inputs, receive user notifications or instructions, interact with or control the appliance, etc. In addition, remote user interface device 410 and remote server 412 may communicate with the appliance to communicate similar information.

In general, communication between the appliance 402, 404, remote user interface device 410, remote server 412, and/or other user devices or appliances may be carried using any type of wired or wireless connection and using any suitable type of communication network, non-limiting examples of which are provided below. For example, remote user interface device 410 may be in direct or indirect communication with the appliance through any suitable wired or wireless communication connections or interfaces, such as network 432. For example, network 432 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 430 is described herein according to an exemplary embodiment of the present subject matter. However, it should be appreciated that the exemplary functions and configurations of external communication system 430 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 4:
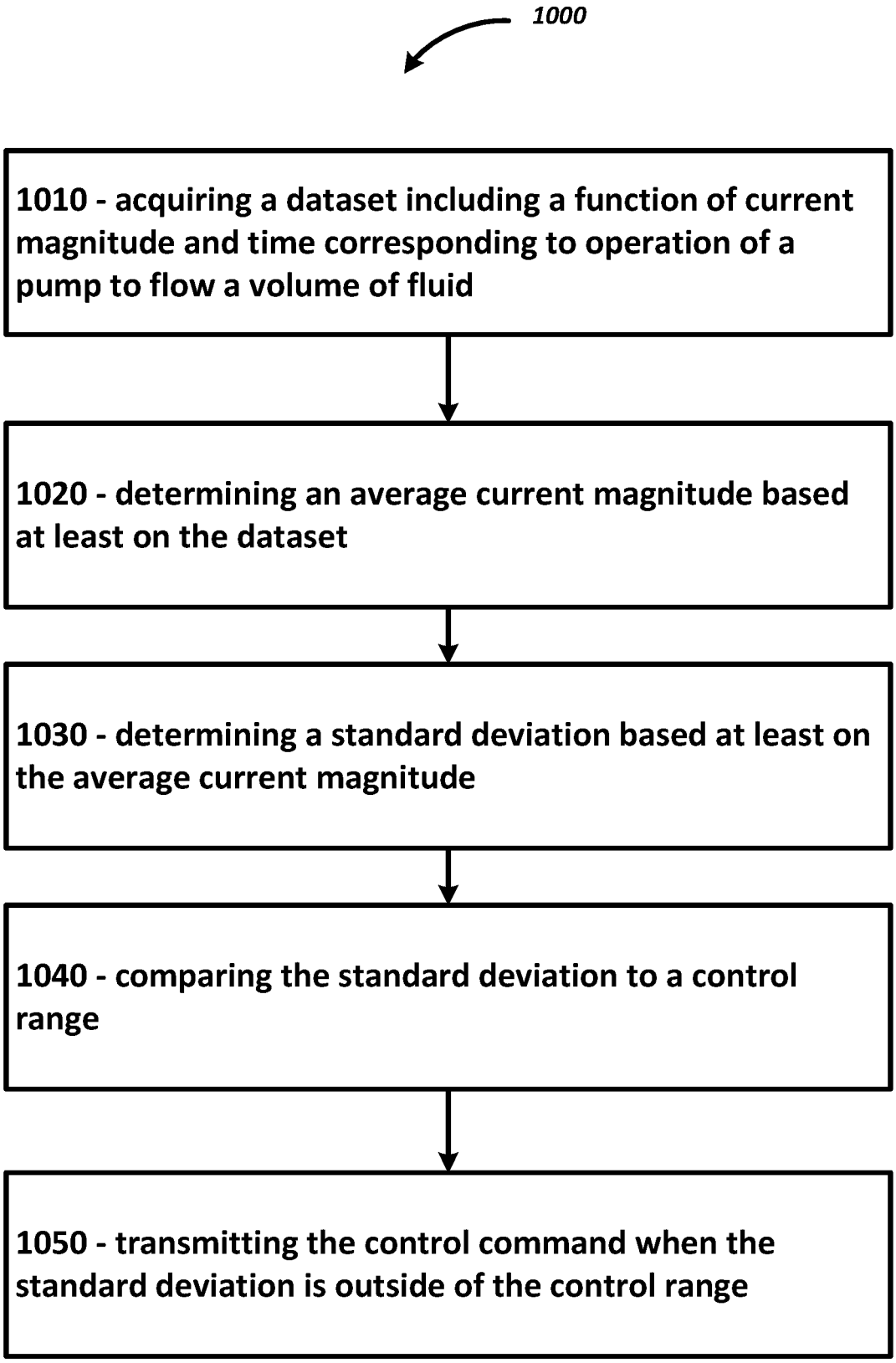
FIG. 4 provides a flow chart illustrating steps of a method for operating an appliance according to exemplary embodiments of the present disclosure.

Referring now to FIG. 4, a flowchart outlining steps of a method for operating a dishwashing appliance is provided (hereinafter, "method 1000"). Steps of the method 1000 may be stored or received at a computing device or controller (e.g., controller 146, 420) as instructions that, when executed, cause an appliance (e.g., appliance 100, 402, 404) to perform operations. Particular embodiments of the method provide water level or other fluid level detection by pattern recognition of motor current. Steps of method 1000 may be distributed across network 432 and executed at one or more of the user interface device 410, the remote server 412, or the local controllers 420 at one or more appliances 402, 404. Various steps of method 1000 include operations executable by the computing device or controller (e.g., controller 146, 420). While the flowchart provided in FIG. 4 may present steps of method 1000 in a particular order, it should be appreciated that steps of method 1000 may be re-ordered, re-arranged, iterated, skipped, or augmented, without deviating from the scope of the present subject matter, unless otherwise provided herein. Furthermore, while a particular embodiment of an appliance is provided in regard to FIGS. 1-3 at which embodiments of the method 1000 may be executed, it should be appreciated that method 1000 may apply generally to any household appliance including a pump (e.g., pump 142, 442) configured to circulate, drain, or otherwise flow a volume of fluid (e.g., water or solution from tub 104), a flow nozzle or dispensing device (e.g., spray assembly 130, 136, 138, flow device 444) configured to eject the fluid provided from the pump, and a motor or other power source (e.g., power source 446) configured to selectively operate the pump to flow the fluid through the flow nozzle. The appliance may furthermore include a control valve or other fluid fill device (e.g., fluid fill device 448) configured to selectively allow and disallow fluid to enter the wash chamber. Such appliances may include dishwashing appliance, laundry washing appliances, or other commercial or household appliances.

Figure 5:
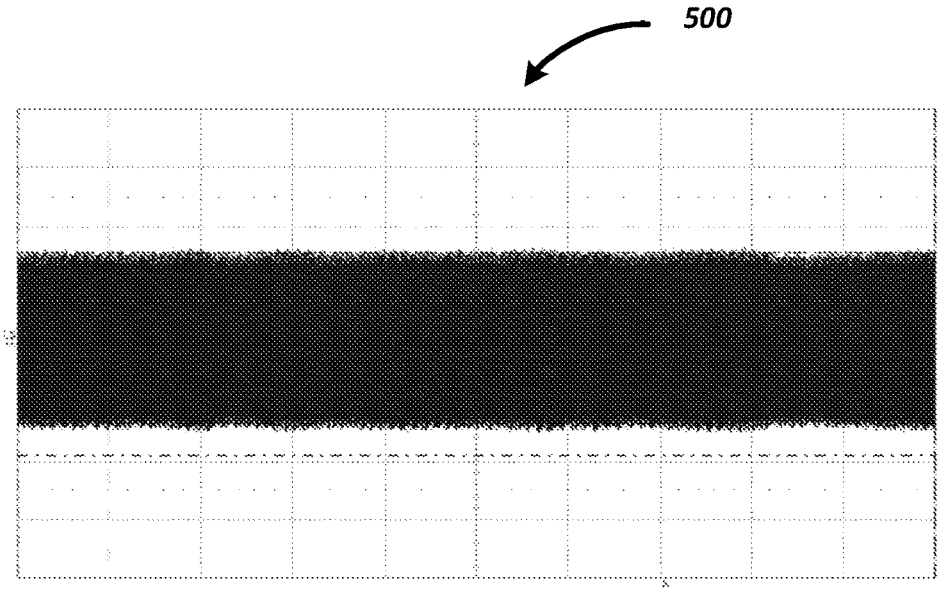
FIG. 5 provides a plot depicting an exemplary operation of the method according to exemplary embodiments of the present disclosure.
Figure 6:
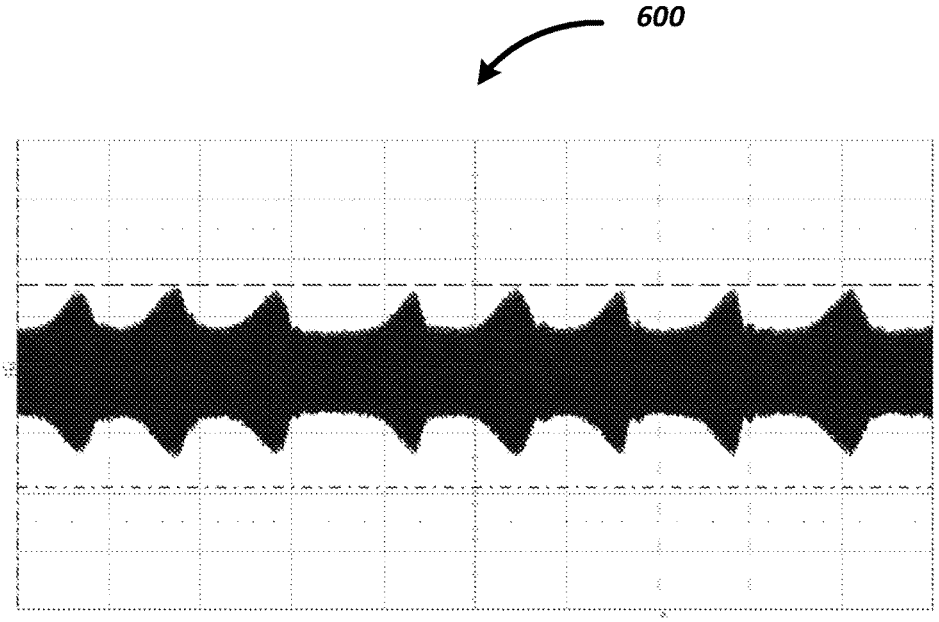
FIG. 6 provides a plot depicting an exemplary operation of the method according to exemplary embodiments of the present disclosure.

Method 1000 includes at 1010 calculating, measuring, obtaining, or otherwise acquiring a dataset including a function of current magnitude and time corresponding to operation of a pump to flow a volume of fluid. The dataset may include a plot, table, graph, chart, or other appropriate data structure. For instance, as depicted in FIG. 5-6, an exemplary embodiment of the system and method acquires a plot 500, 600 of current over time. In FIG. 5, the exemplary plot 500 depicts pump current at a first operating speed corresponding to an appliance having a sufficient amount of fluid for operating the pump effectively. In FIG. 6, the exemplary plot 600 depicts pump current at the first operating speed corresponding to the appliance having an insufficient amount of fluid for effective pump operation. In particular embodiments, method 1000 includes at 1005 operating the motor and pump to flow fluid through the flow nozzle. Particular embodiments of the method 1000 may acquire differences in flow, such as depicted in FIG. 5-6, when the pump operates to flow fluid through the flow nozzle, in contrast to the pump operating without the flow nozzle. In certain embodiments, acquiring the dataset includes acquiring the dataset during operation of the pump and flowing fluid through the flow nozzle. Dataset acquisition may include calculation or other determination of current based on combinations of measured or predetermined energy parameters, such as, but not limited to, power, voltage, apparent power, power factor, line voltage, or phase voltage, or other appropriate given, measured, or measurable parameters at, to, or from a motor or power source.

Figure 7:
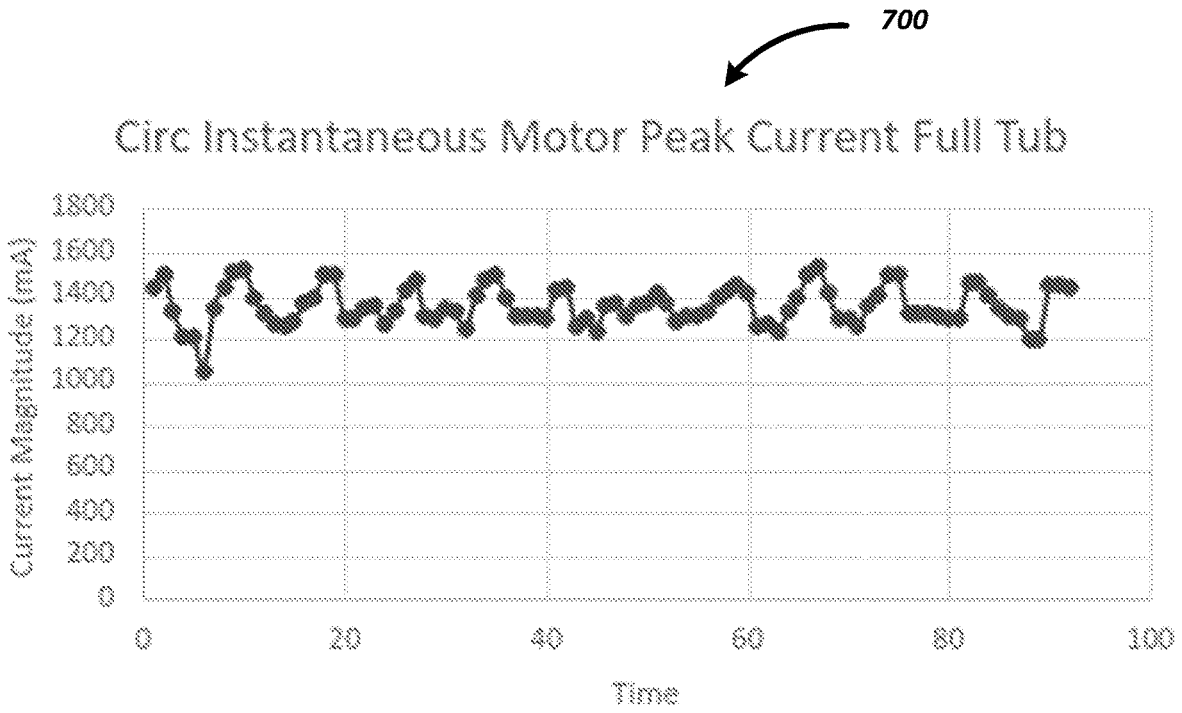
FIG. 7 provides a plot depicting an exemplary operation of the method according to exemplary embodiments of the present disclosure.
Figure 8:
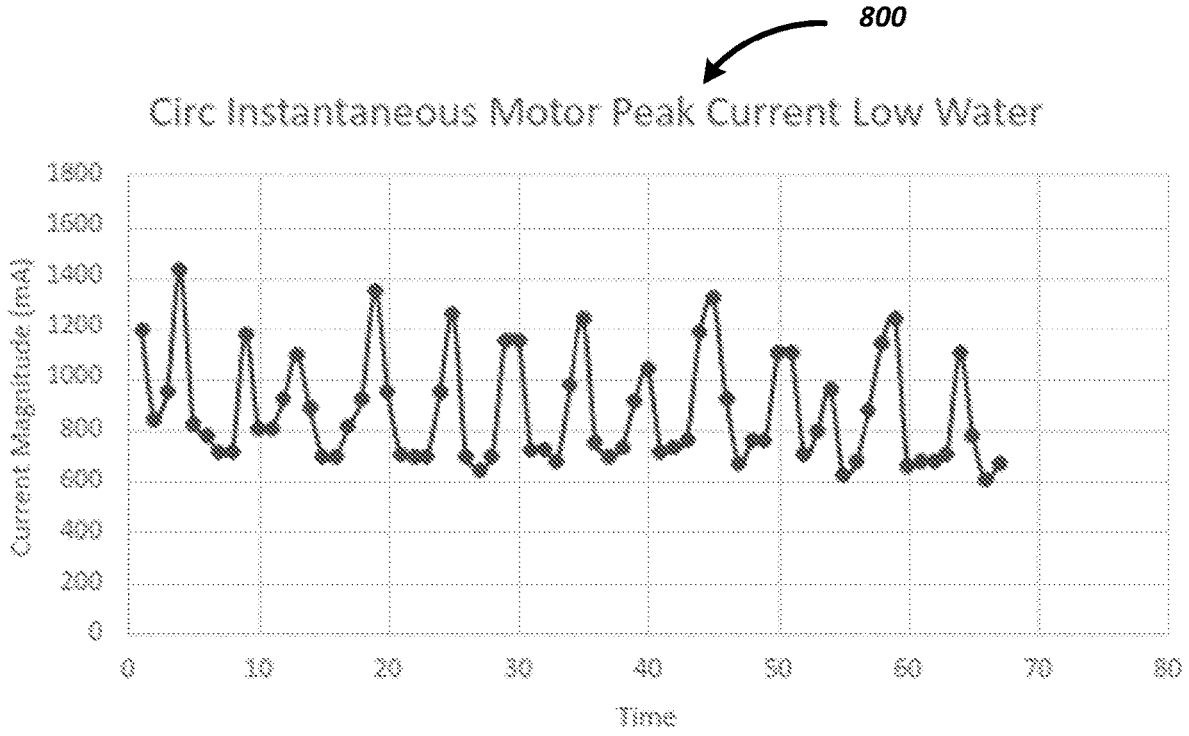
FIG. 8 provides a plot depicting an exemplary operation of the method according to exemplary embodiments of the present disclosure.

Method 1000 includes at 1020 determining an average current magnitude based at least on the dataset. In particular embodiments, determining the average current magnitude includes determining a mean or moving average of the current magnitude. In FIG. 7, an exemplary plot 700 depicts current magnitude over time corresponding to the appliance having a sufficient amount of fluid, such as described in regard to plot 500. In FIG. 8, an exemplary plot 800 depicts current magnitude over time corresponding to the appliance having an insufficient amount of fluid, such as described in regard to plot 600. In various embodiments, the average current magnitude is determined over a predetermined interval. The predetermined interval may correspond to the computing device at which the determination is performed, such as at controller 146, 420, or at the remote server 412. Sample rates and calculations may be adjusted in accordance with controllers or computing devices as may generally be known for appliances such as described herein.

Method 1000 includes at 1030 determining a standard deviation based at least on the average current magnitude. The standard deviation is determined based on the acquired and determined current magnitude over time, such as depicted in FIG. 7-8. A first operating condition may be defined based on the appliance having a sufficient amount of fluid during operation of the pump, such as represented at FIGS. 5 and 7. A second operating condition may be defined based on the appliance having an insufficient amount of fluid during operation of the pump, such as represented at FIGS. 6 and 8.

Method 1000 includes at 1040 comparing the standard deviation to a threshold or control range. In various embodiments, the control range provides a threshold corresponding to various operating conditions. The determined standard deviation is compared to control range. In various embodiments, the threshold or control range corresponds to an operating limit at the appliance, such as the pump or motor. In particular embodiments, the threshold or control range is a limit based on a desired range of standard deviation. Accordingly, the threshold or control range may be irrespective of the specific configuration of the appliance, or components thereof. Referring to FIG. 7, the determined standard deviation may be below the threshold or within the control range, such as to correspond to the first operating condition (e.g., sufficient fluid amount at the appliance). Referring to FIG. 8, the determined standard deviation may be at or above the threshold or outside the control range, such as to correspond to the second operating condition (e.g., insufficient fluid amount at the appliance).

Particular embodiments of the method at 1040 include comparing the standard deviation to the threshold to determine whether to transmit a control command. In various embodiments, the control command is a signal commanding performance of an action at the motor or power source, the pump, or a fluid fill device (e.g., fluid fill device 448) at the appliance. When the standard deviation is within the control range, the method may determine that change in operation or no further action is necessary at the appliance.

In particular embodiments, method 1000 may include at 1050 transmitting the control command when the standard deviation is outside of the control range. When the standard deviation is outside of the control range, the method may determine that the control command is transmitted, such as to command stop fluid fill, to start or continue fluid fill, or to change or adjust pump speed. Accordingly, the control command may correspond to one or more of a stop fill signal, a start fluid fill signal, or a pump speed change signal. In particular embodiments, the control command is a stop fluid fill signal corresponding to ending fluid input to the wash chamber; a start fluid fill signal corresponding to providing, or continuing to provide, fluid to the wash chamber; or a pump speed change signal corresponding to adjusting operation of the pump (e.g., increasing or decreasing pump speed or pressure).

In particular embodiments, determining the standard deviation at 1030 includes determining a relative standard deviation. Determining the relative standard deviation may allow for the determination at 1040 to be based on variance. Basing the method 1000 at 1040 on variance removes dependency on the absolute value of fluid at the appliance. In various embodiments, method 1000 may be performed at various configurations of appliance without requiring discrete inputs of fluid volume, load, pressure, or other fluid parameter. Still further, method 1000 may be executed without regard for specific geometry, area, or volume of the wash chamber or associated manifolds at which the fluid resides.

In other embodiments, method 1000 may include at 1060 acquiring a fluid parameter corresponding to an amount of fluid at the appliance. Method 1000 may further include at 1045 determining the standard deviation based, at least in part, on the fluid parameter. The fluid parameter includes a volume, a load, a pressure, a geometry (e.g., a height, column, etc.), a density, or a combination thereof, corresponding to the amount of fluid at the appliance. Generally, the fluid parameter is indicative of an absolute value of fluid at the appliance. In certain embodiments, method 1000 at 1040 includes the step at 1045.

In a particular exemplary embodiment, method 1000 may be performed at an appliance including a three-phase motor. Method 1000 at 1010 acquires the dataset including the function of acquiring three-phase motor current magnitude signal over time (e.g., a period of time). Three-phase motor current magnitude ($I_m$) may be determined as follows:

$$I_m = \sqrt{\frac{2(i_a^2 + i_b^2 + i_c^2)}{3}}$$

When a sufficient quantity of signals or samples is acquired over time, method 1000 may proceed to 1020 to determine a mean or moving average of the acquired current magnitude. At 1030, the standard deviation or moving standard deviation of current magnitude is determined. Standard deviation of $I_m$ may be determined as follows:

$$\sigma = \sqrt{\frac{\sum (x_i - \mu)^2}{N}}$$

In particular embodiments, method 1000 at 1030 further includes determining relative standard deviation (RSD). RSD may be determined as follows:

$$RSD = 100 * \frac{\sigma}{N}$$

At 1040, the standard deviation, or RSD, is compared to a threshold to determine whether a control command is transmitted, such as to commence, modulate, adjust, or stop operation of the pump, the fluid fill device, or the flow nozzle, or combinations thereof. When the standard deviation is outside of a control range or at or beyond the threshold, the method 1000 at 1050 may transmit the control command, such as to execute an operation at the appliance to bring the standard deviation within the control range or threshold.

In an embodiment in which the pump is a circulation pump, the standard deviation outside of the control range corresponds to low water level. In such an embodiment, the control command executes a start or continue water-fill operation.

In another embodiment in which the pump is a drain pump, the standard deviation outside of the control range corresponds to low water level. In such an embodiment, the control command executes a stop-pump operation.

In still various embodiments, the standard deviation outside of the control range corresponds to low water level. Various embodiments of the method may include acquiring sensor data corresponding to the fluid parameter, and determining the control command based on the standard deviation and the fluid parameter.

It should be appreciated that various embodiments of method 1000 may iteratively and/or intermittently perform one or more steps, such as to periodically or continually determine whether fluid amount, speed, or pressure should be adjusted via the pump, the fluid fill device, or the flow device. Certain embodiments of method 1000 may include repeating one or more of steps 1010, 1020, or 1030 after determining at 1040 that the standard deviation is within the control range or threshold.

Embodiments of method 1000 provided herein allow for statistical determination of operating condition and performance using current amplitude signals. Appliances and systems configured to execute steps of method 1000 may improve efficiency and performance, such as by avoiding operation of the appliance (e.g., the pump) under undesired or adverse operating conditions (e.g., insufficient fluid fill level). Consumer experience may be improved by reduced pump noise, improved appliance durability, and improved fill and drain operation. Control and operation of the appliance based on method 1000 may allow for appliances to include fewer sensors. For instance, embodiments of method 1000 may be performed without acquiring signals corresponding to absolute values of fluid, allowing for the method 1000 to be executed across various configurations of appliance.

Certain embodiments of the system and method may include frequency domain processing. However, actual harmonics associated with variable speed drive motors or pumps may be dependent on particular configurations (e.g., mechanical setups, parameters, components, etc.) at the appliance. Additionally, actual harmonics may shift with changes in speed and may require acquiring configuration-specific data to determine the threshold at which the control command is transmitted.

Still certain embodiments of the system and method may include symbolic aggregate approximation to transform an input time series into strings and K-nearest neighbors or other supervised learning method to classify data. The method may include determining a slope or other appropriate change in measurement over time, quantizing the measurement, and identifying the pattern or plot based on the supervised learning method. However, such an embodiment may require generating and classifying sufficient training data for comparison and determination of operating condition.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A computer-implemented method for operating an appliance, the appliance including a pump configured to flow a volume of fluid, a flow nozzle configured to eject the fluid provided from the pump, and a motor configured to selectively operate the pump to flow the fluid through the flow nozzle, the method comprising:

acquiring a dataset comprising a function of current magnitude and time corresponding to operation of a pump to flow a volume of fluid;

determining an average current magnitude based at least on the dataset;

determining a standard deviation based at least on the average current magnitude; and comparing the standard deviation to a threshold to determine whether to transmit a control command; and transmitting the control command when the standard deviation exceeds the threshold, wherein the control command is a stop fluid fill signal corresponding to ending fluid input to the wash chamber, a start fluid fill signal corresponding to providing fluid to the wash chamber, or a pump speed change signal corresponding to adjusting operation of the pump.

2. The method of claim 1, wherein acquiring the dataset corresponds to operation of the pump and flowing fluid through a flow nozzle.

3. The method of claim 1, wherein determining the average current magnitude comprises determining a mean or moving average of the current magnitude.

4. The method of claim 1, wherein determining the standard deviation comprises determining a relative standard deviation.

5. The method of claim 1, the method comprising:

acquiring a fluid parameter corresponding to an amount of fluid at the appliance; and determining the standard deviation based on the fluid parameter.

6. The method of claim 5, wherein the fluid parameter comprises a volume, a load, a pressure, a height, a density, or a combination thereof, corresponding to the amount of fluid at the appliance.

7. The method of claim 1, wherein acquiring the dataset comprising the function of current magnitude and time comprises acquiring three-phase motor current signals.

8. The method of claim 7, the method comprising:

determining three-phase current magnitude based at least on acquiring three-phase motor current signals.

9. An appliance, the appliance comprising:

a cabinet forming a wash chamber, the wash chamber configured to contain a volume of fluid;

a pump configured to flow the fluid to or from the wash chamber;

a flow nozzle configured to eject the fluid into the wash chamber, the flow nozzle in fluid communication with the pump to receive the fluid therefrom; and a motor operably coupled to the pump, wherein the pump motor is configured to energize the pump to selectively flow the fluid through the flow nozzle;

a controller operably coupled to the motor, the controller configured to perform operations in accordance with steps of the computer-implemented method of claim 1, the operations comprising:

acquiring the dataset comprising a function of current magnitude and time corresponding to operation of the pump to flow the volume of fluid;

determining the average current magnitude based at least on the dataset;

determining the standard deviation based at least on the average current magnitude; and comparing the standard deviation to a threshold to determine whether to transmit the control command to the motor; and transmitting the control command to the motor when the standard deviation exceeds the threshold, wherein the control command is a stop fluid fill signal corresponding to ending fluid input to the wash chamber, a start fluid fill signal corresponding to providing fluid to the wash chamber, or a pump speed change signal corresponding to adjusting operation of the pump.

10. An appliance, the appliance comprising:

a cabinet forming a wash chamber, the wash chamber configured to contain a volume of fluid;

a pump configured to flow the fluid to or from the wash chamber;

a flow nozzle configured to eject the fluid into the wash chamber, the flow nozzle in fluid communication with the pump to receive the fluid therefrom; and a motor operably coupled to the pump, wherein the motor is configured to energize the pump to selectively flow the fluid through the flow nozzle;

a controller operably coupled to the motor, the controller configured to perform operations, the operations comprising:

acquiring a dataset comprising a function of current magnitude and time corresponding to operation of the pump to flow the volume of fluid;

determining an average current magnitude based at least on the dataset;

determining a standard deviation based at least on the average current magnitude;

comparing the standard deviation to a threshold to determine whether to transmit a control command to the motor; and transmitting the control command to the motor when the standard deviation is greater than the threshold, wherein the control command is a stop fluid fill signal corresponding to ending fluid input to the wash chamber, a start fluid fill signal corresponding to providing fluid to the wash chamber, or a pump speed change signal corresponding to adjusting operation of the pump.

11. The appliance of claim 10, wherein acquiring the dataset corresponds to operation of the pump and flowing fluid through the flow nozzle.

12. The appliance of claim 10, wherein determining the average current magnitude comprises determining a mean or moving average of the current magnitude.

13. The appliance of claim 10, wherein determining the standard deviation comprises determining a relative standard deviation.

14. The appliance of claim 10, the operations comprising:

acquiring a fluid parameter corresponding to an amount of fluid at the appliance; and determining the standard deviation based on the fluid parameter.

15. The appliance of claim 14, wherein the fluid parameter comprises a volume, a load, a pressure, a height, a density, or a combination thereof, corresponding to the amount of fluid at the appliance.

16. The appliance of claim 10, wherein the motor is a three-phase motor, and wherein acquiring the dataset comprising the function of current magnitude and time comprises acquiring three-phase motor current signals.

17. The appliance of claim 16, the appliance comprising:

determining three-phase current magnitude based at least on acquiring three-phase motor current signals.

* * * * *